United States Patent [19]

Buescher et al.

[11] 4,210,844

[45] Jul. 1, 1980

[54] CATHODE RAY TUBE ARC SUPPRESSOR COATING

[75] Inventors: William E. Buescher, Seneca Falls; Anthony V. Gallaro, Auburn, both of N.Y.

[73] Assignee: GTE Sylvania Incorporated, Stamford, Conn.

[21] Appl. No.: 962,494

[22] Filed: Nov. 20, 1978

[51] Int. Cl.[2] ..... H01J 29/88; H01J 29/94

[52] U.S. Cl. ..... 313/479; 313/481

[58] Field of Search ..... 313/481, 479, 180, 181, 313/174

[56] References Cited

U.S. PATENT DOCUMENTS

| | | | |
|---|---|---|---|
| 2,159,946 | 5/1939 | De Boer | 313/481 |
| 3,536,527 | 10/1970 | Javorik et al. | 313/479 X |
| 3,791,546 | 2/1974 | Maley et al. | 313/479 X |
| 3,961,221 | 6/1976 | Benda et al. | 313/481 |
| 3,979,633 | 9/1976 | Davis et al. | 313/481 |
| 3,979,806 | 9/1976 | Woodard | 29/25.19 |

FOREIGN PATENT DOCUMENTS 2652277 5/1978 Fed. Rep. of Germany .

*Primary Examiner*—Palmer C. Demeo
*Attorney, Agent, or Firm*—William H. McNeill

[57] ABSTRACT

Arc suppressor coating structures with enhanced limiting characteristics for color cathode ray tubes are achieved by employment of a high electrical resistance coating (30) having, in a specific area, an extremely high resistance (i.e., insulator) coating (46) thereon which provides a seating area for an antenna getter mounted upon the electron gun. The insulator coating is preferably comprised of about 71.2% $Fe_2O_3$ and 28.2% $K_2SiO_3$.

Insulating the antenna getter from, the high resistance coating reduces electrical shorts and keeps arc currents within the range of less than 40 amps. Such results were not previously achievable with antenna getter usage.

5 Claims, 3 Drawing Figures

CATHODE RAY TUBE ARC SUPPRESSOR COATING

TECHNICAL FIELD

This invention relates to arc suppressor coatings for cathode ray tubes and more particularly to such coatings having improved limiting characteristics. Still more particularly the invention concerns electrical isolation of an electron gun mounted antenna getter from an electrically conductive, high resistance coating on the interior of the cathode ray tube envelope.

BACKGROUND ART

Internal, undesired arcs generated within cathode ray tubes (CRT) have long been a problem. As voltage differentials between the electrodes have increased, as for example in modern color CRT's where differentials of 30 KV exist, this problem has become magnified.

Among the most commonly suggested solutions to this problem has been the use of interior conductive coatings having a high electrical resistance to replace the previously employed coatings which were substantially graphite. To achieve the arc limiting capabilities of these high electrical resistance coatings however, it has been necessary to modify either the antenna getter structure or to change the location of the getter so as to avoid the creation of a highly conductive path to the electron gun.

For example, German Offenlegungsschrift No. 2652277 discloses an isolation technique including an insulator between the getter and the convergence cage, a complicated and expensive structure.

U.S. Pat. No. 2,159,946 discloses mounting the getters about the funnel portion of a picture tube, again, a complicated and expensive solution where color picture tubes are concerned because of the difficulty in placing the getters.

U.S. Pat. No. 3,961,221 discloses a wheelbarrow getter arrangement wherein the "wheel" can be formed of an insulating material, such as ceramic. While this device works well in theory, in practice it has been found necessary to keep sublimed getter materials from building up upon the wheel, which causes leakage paths, thus ineffectuating the device.

Yet another technique has involved mounting the getter upon the shadow mask of a color CRT. This solution is shown in U.S. Pat. No. 3,979,633 and 3,979,806. This procedure is also expensive and time consuming, requiring additional operator manipulation.

DISCLOSURE OF INVENTION

The invention provides for the use of high resistance coatings on the interior of color CRT's in conjunction with an antenna getter mounted upon the electron gun to provide an arch suppressor coating with improved limiting characteristics. The invention includes an area of an extremely high resistance material, i.e., an electrical insulator, disposed on the high resistance coating. The antenna getter, which may be provided with a high ceramic base, rests on this area and is thus effectively insulated from the high resistance coating.

This arrangement produces tubes having low arc currents (i.e., less than 40 amps) which have previously been attainable only with shadow mask mounted getters or getters mounted upon the bulb funnel, while maintaining the ease, convenience, and low cost of the gun mounted antenna getter.

BEST MODE FOR CARRYING OUT THE INVENTION

For a better understanding of the present invention, together with other and further objects, advantages and capabilities thereof, reference is made to the following disclosure and appended claims taken in conjunction with the above-described drawings.

Figure 1:
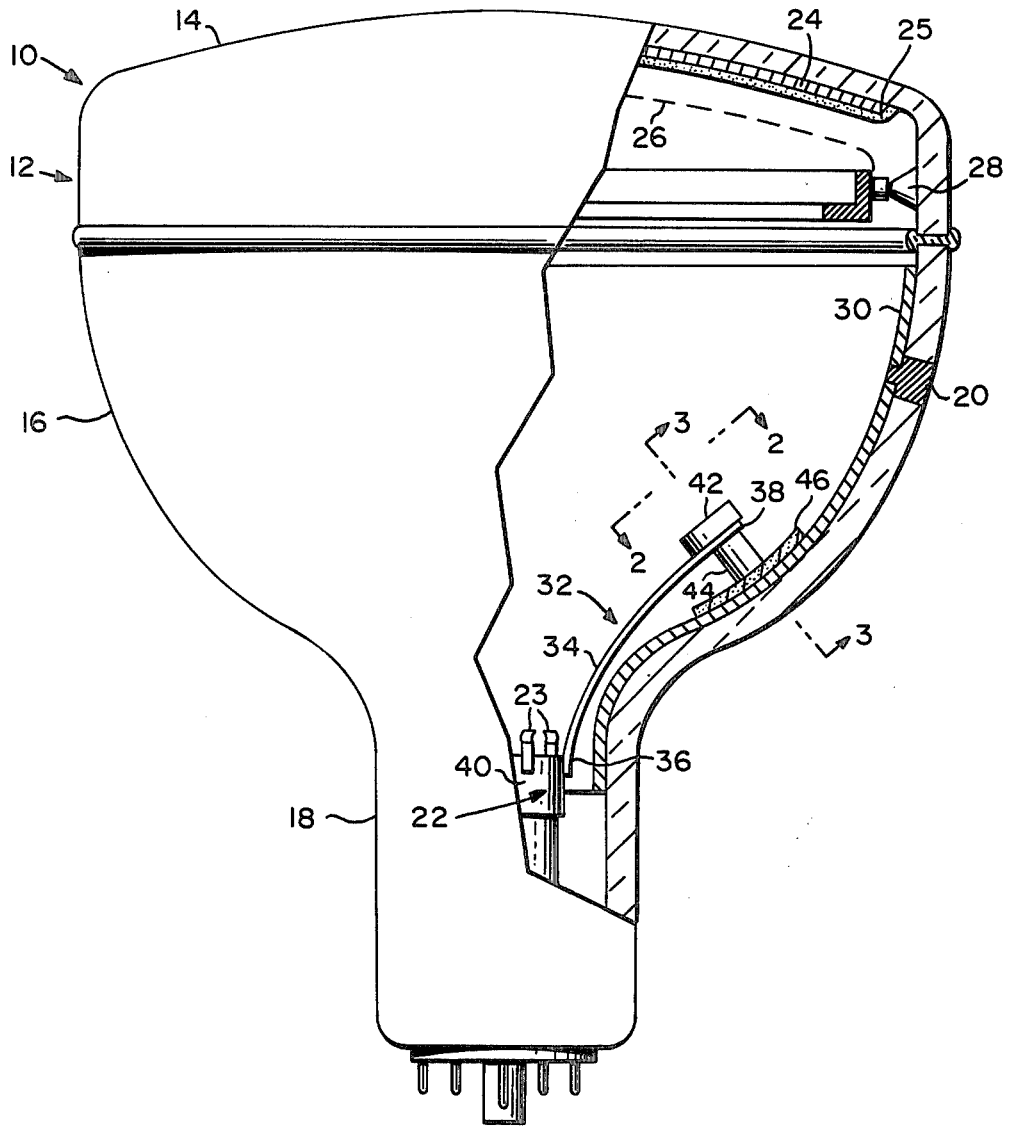
FIG. 1 is a diagrammatic, elevational view of a color cathode ray tube, with parts broken away illustrating an embodiment of the invention.
Figure 2:
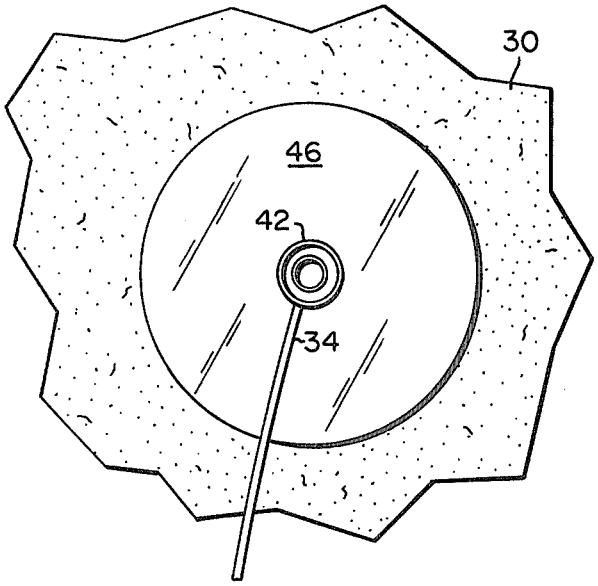
FIG. 2 is a plan view taken along the line 2—2 of FIG. 1.
Figure 3:
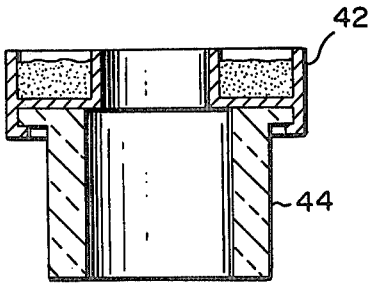
FIG. 3 is a sectional view taken along the line 3—3 of FIG. 1.

Referring now to the drawings with greater particularlity there is shown in FIG. 1 a cathode ray tube 10 having an envelope 12 which includes a face panel 14 sealed to a funnel 16 which terminates in a neck 18. An anode button 20 suitable for connection to a source of high voltage (e.g. about 30 KV) is embedded in funnel 16 and a mount assembly or electron gun 22 having affixed snubber members 23 is sealed into neck 18.

In the usual manner the face panel 14 has an inner surface having thereon a patterned, cathodo-luminescent screen 24 of light emitting phosphors with a layer of light reflecting material, 25, e.g. aluminum affixed thereto. A shadow mask 26 is spaced from the light reflecting layer 25 and is attached to a support 28 on panel 14.

An internal, electrically conductive coating 30 having a high electrical resistance extends from the region of the screen 24 to neck 18 and is contacted by snubbers 23.

Coating 30 is fabricated to utilize minimal amounts of conductive graphite particles and increased amount of insulative oxide particles and preferred formulation includes insulator oxide particles in the range of about 50–65 weight parts, graphite particles in the range of about 4–10 weight parts and silicate solids in the range of about 24–35 weight parts. The material can be applied from a suspension either automatically or by brush and will provide a resistance value in the range of 20K ohms to 7 Meg ohms.

The insulator oxide particles can be selected from ferric oxide, ferrous-ferric oxide, chromic oxide, aluminum oxide, nickel oxide, titanium oxide, and nickel sesqui-oxide, with ferric oxide being preferred.

For the silicate solids used as binder materials, potassium silicate is preferred; however, sodium silicate or lithium silicate, alone or mixtures thereof with each other and/or potassium silicate are appropriate.

An antenna getter 32 is comprised of an electrically conductive, flexible metal shaft 34 having a proximal end 36 and a distal end 38 and is connected at the proximal end 36 to the final electrode 40 of electron gun 22. The distal end 38 carries a getter ring 42 containing a suitable gettering material.

The side of getter ring 42 adjacent to coating 30 is provided with a ceramic insulator 44 attached thereto. Insulator 44 is generally tubular and has a height measured along its vertical axis as great as possible without interferring with the deflected electron beams.

Interposed between the insulator 44 and coating 30 is an extremely high resistance layer 46. Layer 46 preferably has a resistance value high enough to appear as an insulator; i.e., a value about 100 times that of coating 30, and covers an area from about 4 to 9 sq. ins. to provide ease of getter location and to avoid bridging by the conductive getter material after vaporization.

Layer 46 is preferably comprised of about 71.2% $Fe_2O_3$ and the remainder $K_2SiO_3$. Alternatively, any of the previously mentioned oxides and silicates can be used.

Employment of the invention described herein allows the getter to be fastened to the mount and thus easily installed during mount sealing. The position of the getter on the extremely high resistance (i.e., insulator) coating prevents the getter shaft from electrically shorting the high resistance material and provides a tube with improved limiting characteristics.

While there have been shown and described what are at present considered to be the preferred embodiments of the invention, it will be apparent to those skilled in the art that various changes and modifications can be made herein without departing from the scope of the invention as defined by the appended claims.

INDUSTRIAL APPLICABILITY

This invention is useful in the manufacture of color cathode ray tubes employing high resistance arc suppressor coatings on the interior of the bulb. The coatings are easily applied by brush or spray or other conventional techniques and the arrangement of the coatings allows the use of gun mounted antenna getters.

We claim:

1. In a cathode ray tube comprised of a glass envelope having a viewing screen at one end thereof and a multi electrode electron gun formed for directing a beam of electrons to said screen at an opposite end thereof; an electrically conductive coating having a high electrical resistance disposed on the interior surface of said glass envelope and extending from said screen to said electron gun, said high electrical resistance coating having a resistance of from about 20,000 ohms to about 7 megohms and comprising a mixture of $Fe_2O_3$, $K_2SiO_3$ and graphite; the final electrode of said gun being electrically connected to said coating; and an antenna getter comprised of an electrically conductive, flexible metal shaft having a proximal end and a distal end, said proximal end being connected to said final electrode and said distal end carrying a getter device, the improvement comprising: a layer of extremely high resistance material overlying a portion of said high resistance coating, said extremely high resistance coating having a resistance about 100 times greater than said high resistance coating and comprising a mixture of $Fe_2O_3$ and a silicate, said getter device being in contact with said extremely high resistance layer.

2. The cathode ray tube of claim 1 wherein said silicate is selected from the group of sodium silicate and potassium silicate.

3. The cathode ray tube of claim 1 wherein said extremely high resistance coating comprises about 70% $Fe_2O_3$ and about 30% $K_2SiO_3$.

4. The cathode ray tube of claim 1 wherein said extremely high resistance coating comprises about 71.2% $Fe_2O_3$ and about 28.8% $K_2SiO_3$.

5. The cathode ray tube of claim 1 wherein said getter device comprises a channeled annulus containing a vaporizable getter material and a ceramic base attached to said annulus, said base being in contact with said extremely high resistance coating.

* * * * *